US006779512B2

(12) United States Patent
Mitsutani

(10) Patent No.: US 6,779,512 B2
(45) Date of Patent: Aug. 24, 2004

(54) APPARATUS AND METHOD FOR CONTROLLING INTERNAL COMBUSTION ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/626,734

(22) Filed: Jul. 25, 2003

(65) Prior Publication Data

US 2004/0129259 A1 Jul. 8, 2004

(30) Foreign Application Priority Data

Jul. 25, 2002 (JP) ..... 2002-217078
Jul. 23, 2003 (JP) ..... 2003-200733

(51) Int. Cl.[7] ..... F02M 33/02
(52) U.S. Cl. ..... 123/519; 123/520
(58) Field of Search ..... 123/519, 520, 123/521, 704

(56) References Cited

U.S. PATENT DOCUMENTS 6,095,121 A * 8/2000 Osanai ..... 123/520

FOREIGN PATENT DOCUMENTS

JP 10-227242 A 8/1998
JP 2001-304055 10/2001

* cited by examiner

*Primary Examiner*—Bibhu Mohanty
(74) *Attorney, Agent, or Firm*—Kenyon & Kenyon

(57) ABSTRACT

Gas containing fuel vapor is purged as purge gas from a canister to an intake passage of an engine through a purge line. An ECU renews a vapor concentration value representing the concentration of fuel vapor contained in the purge gas by a predetermined renew amount at a time in response to a deviation of a detected air-fuel ratio relative to a target air-fuel ratio. The ECU sets the amount of fuel supplied to the combustion chamber of the engine according to the renewed vapor concentration value such that the detected air-fuel ratio seeks the target air-fuel ratio. The ECU computes the ratio of air flowing through the intake passage to a predetermined maximum air flow rate, and sets the computed ratio as an engine load ratio. The ECU sets a smaller value of the renew amount for a greater value of the engine load ratio. As a result, the learning of the vapor concentration is reliably performed, and the accuracy of the air-fuel ratio control is improved.

13 Claims, 10 Drawing Sheets

APPARATUS AND METHOD FOR CONTROLLING INTERNAL COMBUSTION ENGINE

BACKGROUND OF THE INVENTION

The present invention relates to an apparatus and a method for controlling an internal combustion engine that has a fuel vapor treating apparatus, which collects fuel vapor in a fuel tank to a canister without releasing the fuel vapor into the atmosphere and purges the collected fuel vapor to the intake passage of the engine as necessary.

A typical internal combustion engine driven with volatile liquid fuel includes a fuel vapor treating apparatus. The fuel vapor treating apparatus has a canister for temporarily storing fuel vapor generated in a fuel tank. When necessary, fuel vapor collected by an adsorbent in the canister is purged to the intake passage of the engine from the canister through a purge passage, and is mixed with air drawn into the engine. The fuel vapor is combusted in the combustion chamber of the engine together with fuel injected from the injector. A purge control valve located in the purge passage adjusts the flow rate of gas (purge gas) containing fuel vapor to the intake passage.

In the above internal combustion engine, the air-fuel ratio of combustible gas mixture supplied to the combustion chamber is detected. The amount of fuel injected from the injector is controlled such that the detected actual air-fuel ratio matches with a target value. To optimally control the air-fuel, the amount of fuel injected from the injector needs to be controlled by taking the amount of fuel vapor purged to the intake passage through the purge passage into consideration.

Typically, the amount of injected fuel is controlled in the following manner when the influence of fuel vapor is taken into consideration. First, a basic fuel injection amount (time) is computed based on parameters indicating the running state of the engine, such as the engine speed and the intake flow rate. Then, a final fuel injection amount (time) is determined by adjusting the basic fuel injection amount with a air-fuel ratio feedback correction factor, an air-fuel ratio learning value, a purging air-fuel ratio correction factor, and correction factors obtained based on the running states. The air-fuel ratio feedback correction factor corresponds to the difference between the air-fuel ratio of the previous fuel injection relative and the stoichiometric air-fuel ratio. The air-fuel ratio feedback correction factor is used for permitting the air-fuel ratio in the current fuel injection to approximate the stoichiometric air-fuel ratio. The air-fuel ratio learning value is a correction factor that is learned and stored for each running state region based on the results of air-fuel ratio feedback control in different running state regions. Using the air-fuel ratio learning value improves the accuracy of the air-fuel ratio feedback control.

The purge air-fuel ratio correction factor is obtained by considering the influence of the fuel vapor introduced into the intake passage to the air-fuel ratio. The purge air-fuel ratio correction factor is computed based on a purge ratio and a vapor concentration learning value. The purge ratio refers to a coefficient that represents the ratio of the flow rate of purge gas introduced into the intake passage to the flow rate of intake air in the intake passage. The vapor concentration learning value refers to a coefficient that reflects the concentration of the vapor component in the purge gas. The product of the purge ratio and the vapor concentration learning value is used as the purge air-fuel ratio correction factor for correcting the air-fuel ratio.

When the air-fuel ratio deviates from a target air-fuel ratio while fuel vapor is being purged, the vapor concentration learning value, which is used for computing a purging air-fuel ratio correction factor, is renewed. At this time, if the vapor concentration learning value is renewed by a certain amount that has been determined regardless of the purge ratio, the air-fuel ratio is deviated from the target air-fuel ratio particularly when the purge ratio changes from a smaller value to a greater value.

That is, the air fuel ratio of an internal combustion engine is fluctuated not only by the influence of purging, but also by changes in the running state of the vehicle. Therefore, if the deviation of the air-fuel ratio is entirely reflected on the renew amount of the vapor concentration learning value on the assumption that deviation of the air-fuel ratio is entirely caused by the influence of the purging, the computed vapor concentration learning value is deviated from the actual vapor concentration. When the purge ratio is not changing or small, deviation of the vapor concentration learning value from the actual vapor concentration causes no drawbacks. However, when the purge ratio changes from a smaller value to a greater value, deviation of the vapor concentration learning value causes a problem.

For example, suppose that the air-fuel ratio is deviated from a target air-fuel ratio by 2% due to changes in the running state of the vehicle, not due to the influence of purging, and that the purge ratio is small, for example, 0.5%. At this time, if the deviation of the air-fuel ratio is entirely reflected on the renew amount of the vapor concentration learning value on the assumption that the deviation of the air-fuel ratio is entirely caused by the influence of the purging, the computed vapor concentration learning value is deviated from the actual vapor concentration by 4% per unit purge ratio (4%=2%/0.5%). In this case, if the purge ratio is maintained at 0.5%, the computed vapor concentration learning value continues to be different from the actual vapor concentration by 4%.

However, if the purge ratio is increased from 0.5% to 5%, the deviation of the computed vapor concentration learning value will be 20% (20%=4% (deviation per unit purge ratio)×purge ratio 5%). When the deviation of the computed vapor concentration learning value is 20%, a fuel injection amount corrected based on the computed vapor concentration learning value is significantly deviated from a fuel injection amount required for maintaining the target air-fuel ratio. Accordingly, the air-fuel ratio is significantly deviated from the target air-fuel ratio.

On the other hand, if the air-fuel ratio is deviated from a target air-fuel ratio by 2% due to the influence of the running state of the vehicle, and the purge ratio is a great value, for example 5%, the computed vapor concentration learning value is only 0.4% per unit purge ratio (0.4%=2%/5%). Therefore, the errors of the vapor concentration learning value are insignificant. Also, when the purge ratio falls from a great value, the deviation of the vapor concentration learning value is gradually decreased, which causes no particular drawbacks. That is, problems are caused by renewal of the vapor concentration learning value while the purge ratio is low.

To solve such problems, Japanese Laid-Open Patent Publication No. 10-227242, for example, discloses an art in which, when a vapor concentration learning value is renewed, the renew amount is set to a smaller value if a purge ratio is a small value compared to a case where the purge ratio is a great value. This prevents an erroneous learning of the vapor concentration due to a deviation of the air-fuel ration caused by the influence of the running state of a vehicle.

As described above, a purge ratio is a theoretical ratio of the flow rate of purge gas introduced to an intake passage to the flow rate of intake air flowing through the intake passage. A small value of the purge ratio represents that the flow rate of purge gas is small relative to the flow rate of intake air. Therefore, when the intake air flow rate is increased and the intake negative pressure acting on the intake passage is decreased (or when the intake pressure is increased), the purge ratio has a small value. The purge gas flow rate is also changed according to the intake pressure acting o the intake passage. Since the pressure loss in the intake negative pressure varies for each internal combustion engine, the purge gas flow rate varies for each internal combustion engine if the intake negative pressure and the purge ratio are both small. However, the method disclosed in the above publication simply sets the renew amount of a vapor concentration learning value to a small value when the purge ratio is small, but does not take variations of the purge gas flow rate into consideration. This method can cause an erroneous learning of the vapor concentration. Accordingly, the concentration of fuel vapor is not accurately obtained when the purge ratio is small. This results in an inaccurate computation of fuel injection amount, and lowers the accuracy of the air-fuel ratio control.

SUMMARY OF THE INVENTION

Accordingly, it is an object of the present invention to provide an apparatus and a method for controlling an internal combustion engine, in which apparatus and method a vapor concentration is learned in a favorable manner and the accuracy of an air-fuel ratio control is improved.

To achieve the foregoing and other objectives and in accordance with the purpose of the present invention, an apparatus for controlling the air-fuel ratio of air-fuel mixture drawn into a combustion chamber of an engine is provided. An intake passage of the engine is connected to a canister, which adsorbs fuel vapor generated in a fuel tank. Gas containing fuel vapor is purged as purge gas from the canister to the intake passage through a purge control device by intake negative pressure generated in the intake passage. The apparatus includes a computer and a sensor for detecting the air-fuel ratio of the air-fuel mixture. According to a deviation of a detected air-fuel ratio relative to a target air-fuel ratio, the computer renews a vapor concentration value representing the concentration of fuel vapor contained in the purge gas by a predetermined renew amount at a time. The computer sets the amount of fuel supplied to the combustion chamber according to the renewed vapor concentration value such that the detected air-fuel ratio seeks the target air-fuel ratio. The computer sets a smaller value of the renew amount for a greater value of the load on the engine.

The present invention also provides a method for controlling the air-fuel ratio of air-fuel mixture drawn into a combustion chamber of an engine. An intake passage of the engine is connected to a canister, which adsorbs fuel vapor generated in a fuel tank. Gas containing fuel vapor is purged as purge gas from the canister to the intake passage through a purge control device by intake negative pressure generated in the intake passage. The method includes: detecting the air-fuel ratio of the air-fuel mixture; renewing a vapor concentration value representing the concentration of fuel vapor contained in the purge gas by a predetermined renew amount at a time according to a deviation of a detected air-fuel ratio relative to a target air-fuel ratio; setting the amount of fuel supplied to the combustion chamber according to the renewed vapor concentration value such that the detected air-fuel ratio seeks the target air-fuel ratio; and setting a smaller value of the renew amount for a greater value of the load on the engine.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A controller for an internal combustion engine 8 according to one embodiment of the present invention will now be described with reference to drawings.

Figure 1:
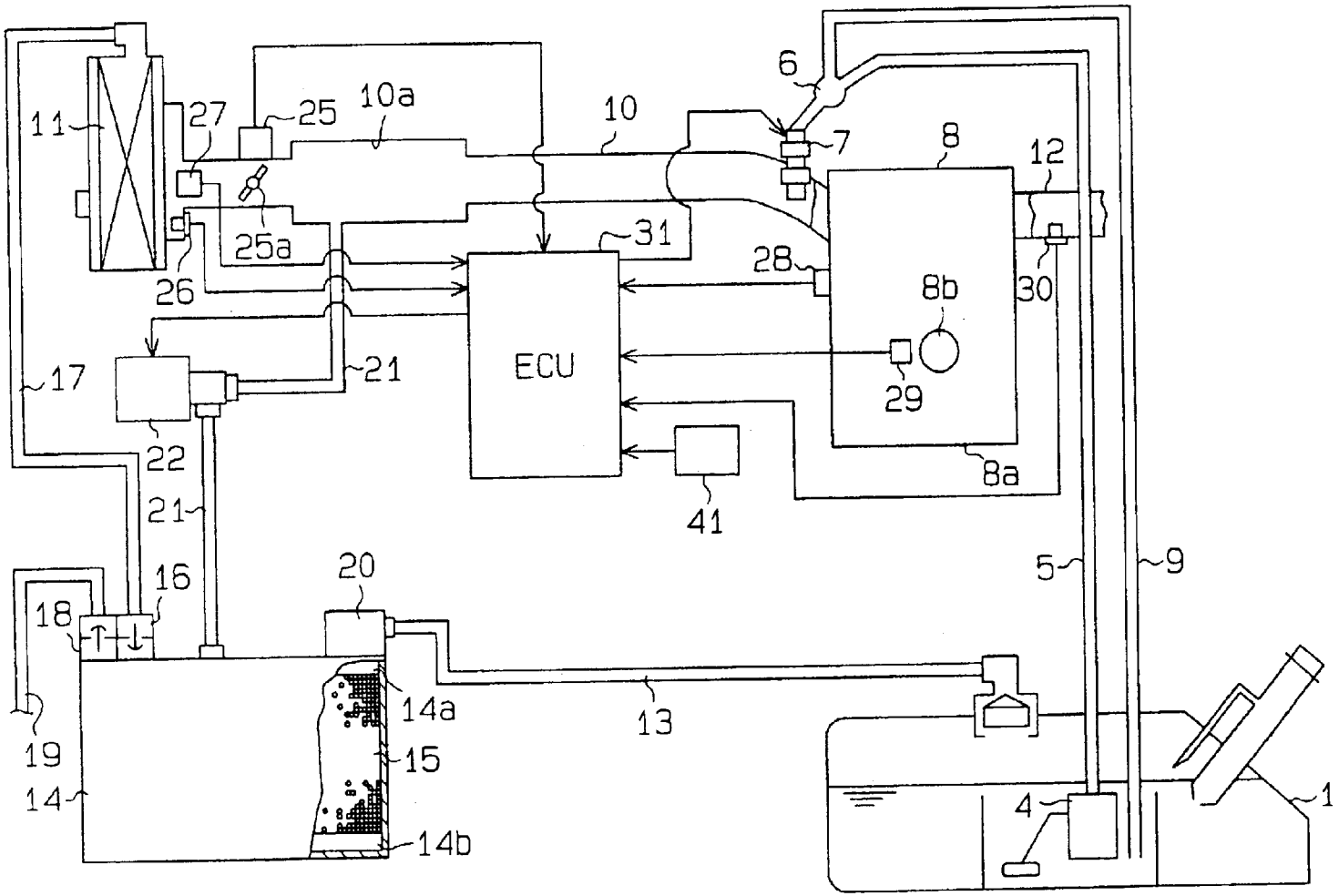
FIG. 1 is a schematic diagram illustrating an internal combustion engine system according to one embodiment of the present invention.

FIG. 1 is a schematic diagram illustrating a vehicular engine system having the fuel vapor treating apparatus according to the first embodiment. The system has a fuel tank 1 for storing fuel.

A pump 4 is located in the fuel tank 1. A main line 5 extends from the pump 4 and is connected to a delivery pipe 6. The delivery pipe 6 has injectors 7, each of which corresponds to one of the cylinders (not shown) of the engine 8. A return line extends from the delivery pipe 6 and is connected to the fuel tank 1. Fuel discharged by the pump 4 reaches the delivery pipe 6 through the main line 5 and is then distributed to each injector 7. Each injector 7 is controlled by an electronic control unit (ECU) 31, which is a computer, and injects fuel into the corresponding cylinder of the engine 8.

An air cleaner 11 and a surge tank 10*a* are located in an intake passage 10 of the engine 8. Air that is cleaned by the air cleaner is drawn into the intake passage 10. Fuel injected from each injector 7 is mixed with the cleaned air. The mixture is supplied to the corresponding cylinder of the engine 8 and combusted. Some of the fuel in the delivery pipe 6 is not supplied to the injectors 7 and is returned to the fuel tank 1 through the return line 9. After combustion, exhaust gas is discharged to the outside from the cylinders of the engine 8 through an exhaust passage 12.

The fuel vapor treating apparatus collects fuel vapor generated in the fuel tank 1 without emitting the fuel vapor into atmosphere. The treating apparatus has a canister 14 for collecting fuel vapor generated in the fuel tank 1 through a vapor line 13. Adsorbent 15 such as activated carbon fills part of the canister 14. Spaces 14*a*, 14*b* are defined above and below the absorbent 15, respectively.

A first atmosphere valve 16 is attached to the canister 14. The first atmosphere valve 16 is a check valve. When the pressure in the canister 14 is lower than the atmospheric pressure, the first atmosphere valve 16 is opened to permit the outside air (the atmospheric pressure) to flow into the canister 14 and prohibits a gas flow in the reverse direction. An air pipe 17 extends from the first atmosphere valve 16. The air pipe 17 is connected to the air cleaner 11. Therefore, outside air that is cleaned by the air cleaner 11 is drawn into the canister 14. A second atmosphere valve 18 is located in the canister 14. The second atmosphere valve 18 is also a check valve. When the pressure in the canister 14 is higher than the atmospheric pressure, the second atmosphere valve 18 is opened and permits air to flow from the canister 14 to an outlet pipe 19 and prohibits airflow in the reverse direction.

A vapor control valve 20 is attached to the canister 14. The vapor control valve 20 controls fuel vapor that flows from the fuel tank 1 to the canister 14. The control valve 20 is opened based on the difference between the pressure in a zone that includes the interior of the fuel tank 1 and the vapor line 13 and the pressure in the canister 14. When opened, the control valve 20 permits vapor to flow into the canister 14.

A purge line 21 extends from the canister 14 and is connected to the surge tank 10*a*. The canister 14 collects only fuel component in the gas supplied to the canister 14 through the vapor line 13 by adsorbing the fuel component with the adsorbent 15. The canister 14 discharges the gas of which fuel component is deprived to the outside through the outlet pipe 19 when the atmosphere valve 18 is opened. When the engine 8 is running, an intake negative pressure created in the intake passage 10 is applied to the purge line 21. If a purge control valve 22, which is located in the purge line 21, is opened in this state, fuel vapor collected by the canister 14 and fuel that is introduced into the canister 14 from the fuel tank 1 but is not adsorbed by the adsorbent 15 are purged to the intake passage 10 through the purge line 21. The purge control valve 22 is an electromagnetic valve, which moves a valve body in accordance with supplied electric current. The opening degree of the purge control valve 22 is duty controlled by the ECU 31. Accordingly, the flow rate of purge gas containing fuel vapor through the vapor line 21 is adjusted according to the running state of the engine 8. The purge control valve 22 functions as a purge control device for adjusting the purge gas flow rate.

The running state of the engine 8 is detected by various sensors 25–30. A throttle sensor 25 is located in the vicinity of a throttle 25*a* in the intake passage 10. The throttle sensor 25 detects a throttle opening degree TA, which corresponds to the degree of depression of a gas pedal, and outputs a signal representing the opening degree TA. An intake air temperature sensor 26 is located in the vicinity of the air cleaner 11. The intake air temperature sensor 26 detects the temperature of air drawn into the intake passage 10, or intake temperature THA, and outputs a signal representing the temperature THA. An intake flow rate sensor 27 is also located in the vicinity of the air cleaner 11. The intake flow rate sensor 27 detects the flow rate of air drawn into the intake passage 10, or the intake flow rate Q, and outputs a signal representing the intake flow rate Q. A coolant temperature sensor 28 is located in the engine 8. The coolant temperature sensor 28 detects the temperature of coolant flowing through an engine block 8*a*, or the coolant temperature THW, and outputs a signal representing the coolant temperature THW. A crank angle sensor (rotation speed sensor) 29 is located in the engine 8. The crank angle sensor 29 detects rotation speed of a crankshaft 8*b* of the engine 8, or the engine speed NE, and outputs a signal that represents the engine speed NE. An oxygen sensor 30 is located in the exhaust passage 12. The oxygen sensor 30 detects the concentration of oxygen in exhaust gas flowing through the exhaust passage and outputs a signal representing the oxygen concentration. The concentration of oxygen in exhaust gas represents the air-fuel ratio of air-fuel mixture supplied to the combustion chambers of the engine 8. Therefore, the oxygen sensor 30 functions as an air-fuel ratio sensor.

The ECU 31 receives signals from the sensors 25–30. The ECU 31 also executes air-fuel ratio control for controlling the amount of fuel injected by the injectors 7 such that the air-fuel ratio of the air-fuel mixture in the engine 8 matches a target air-fuel ratio, which is suitable for the running state of the engine 8.

The ECU 31 also controls the purge control valve 22 to adjust the purge gas flow rate to a value that is suitable for the running state of the engine 8. That is, the ECU 31 determines the running state of the engine 8 based on the signals from the sensors 25–30. Based on the determined running state, the ECU 31 duty controls the purge control valve 22. Fuel vapor that is purged from the canister 14 to the intake passage 10 influences the air-fuel ratio of the air-fuel mixture in the engine 8. Therefore, the ECU 31 determines the opening degree of the purge control valve 22 in accordance with the running state of the engine 8.

While the purging process is being executed, the ECU 31 learns the concentration of fuel vapor in purge gas (vapor concentration) based on the result of the air-fuel ratio control and the oxygen concentration detected by the oxygen sensor 30. When the air-fuel ratio is lowered, or when the air-fuel mixture is rich, the concentration of CO in the exhaust gas of the engine 8 is increased and the oxygen concentration is decreased. Thus, the ECU 31 learns a vapor concentration value FGPG based on the oxygen concentration in the exhaust gas, which is detected by the oxygen sensor 30. In other words, the ECU 31 computes the vapor concentration value FGPG based on the difference between the target air-fuel ratio and the detected air-fuel ratio. The ECU 31 determines a duty ratio DPG based on the vapor concentration value FGPG. The duty ratio DPG corresponds to the opening degree of the purge control valve 22. The ECU 31 sends a driving pulse signal that corresponds to the duty ratio DPG to the purge control valve 22.

Basically, the ECU 31 adjusts a basic fuel injection amount (time) TP, which is previously determined based on the running state of the engine 8. Specifically, the ECU 31 adjusts the basic fuel injection amount TP based on the vapor concentration learning value FGPG, an air-fuel ratio feedback correction factor FAF, which is computed in air-fuel ratio feedback control, thereby determining a final target fuel injection amount (time) TAU.

Figure 2:
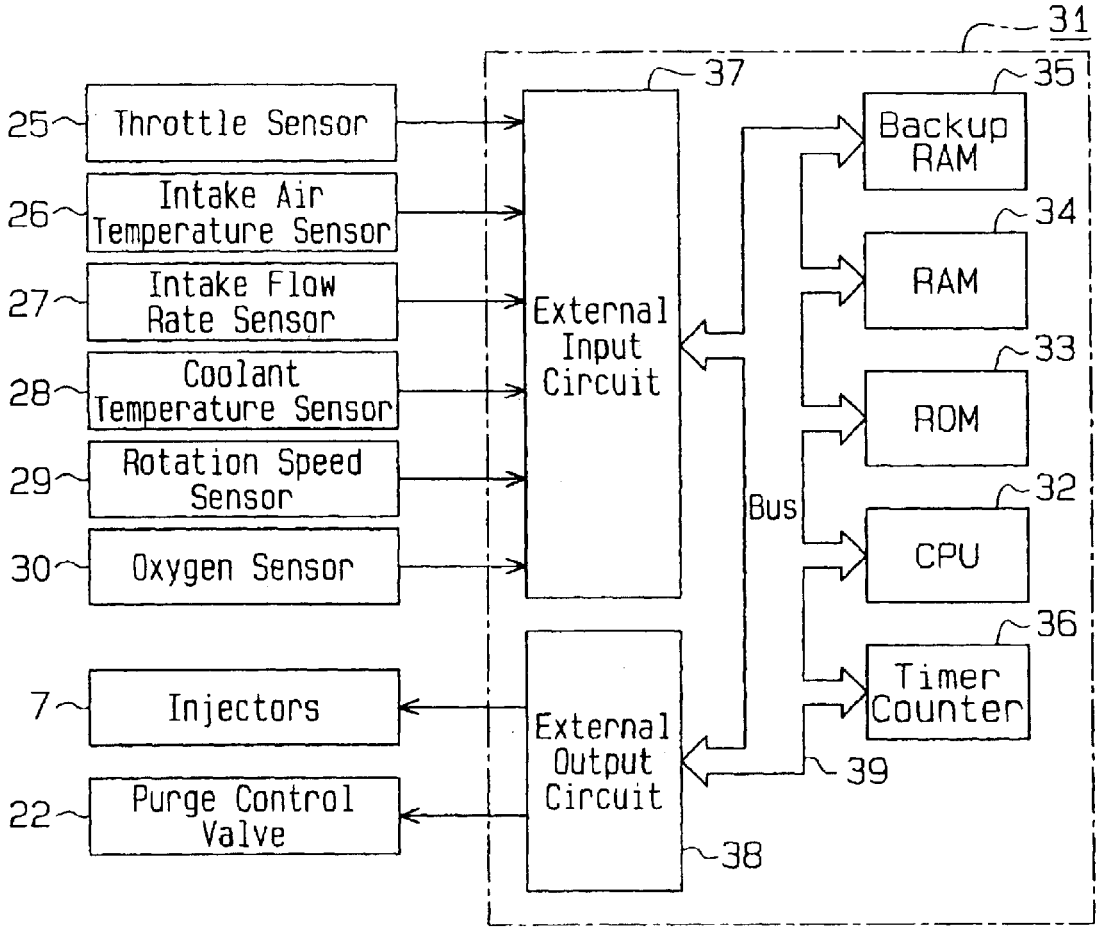
FIG. 2 is a block diagram showing an electrical construction of the electronic control unit (ECU) of the engine system shown in FIG. 1.

As shown in the block diagram of FIG. 2, the ECU 31 includes a central processing unit (CPU) 32, a read only memory (ROM) 33, a random access memory (RAM) 34, a backup RAM 35, and a timer counter 36. The devices 32–36 are connected to an external input circuit 37 and an external output circuit 38 by a bus 39 to form a logic circuit. The ROM 33 previously stores predetermined control programs used for the air-fuel ratio control and purge control. The RAM 34 temporarily stores computation results of the CPU 32. The backup RAM 35 is a battery-protected non-volatile RAM and stores data even if the ECU 31 is not activated, or is turned off. The timer counter 36 simultaneously is capable of performing several time measuring operations. The external input circuit 37 includes a buffer, a waveform shaping circuit, a hard filter (a circuit having a resistor and a capacitor), and an analog-to-digital converter. The external output circuit 38 includes a driver circuit. The sensors 25–30 are connected to the external input circuit 37. The injectors 7 and the purge control valve 22 are connected to the external output circuit 38.

The CPU 32 receives signals from the sensors 25–30 through the external input circuit 37. The CPU 32 executes the air-fuel ratio feedback control, the air-fuel ratio learning process, the purge control, the vapor concentration learning process, and the fuel injection control.

Figure 3:
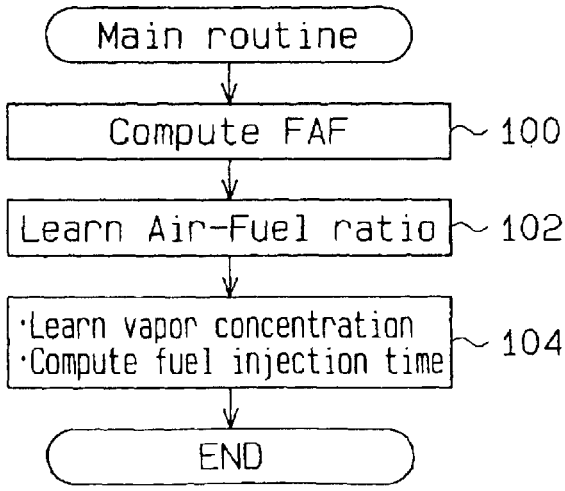
FIG. 3 is a flowchart showing a main routine of a method for controlling air-fuel ratio executed by the electronic control unit shown FIG. 2.

FIG. 3 is a flowchart showing the main routine of the air-fuel ratio control procedure executed by the ECU 31. The ECU 31 executes the main routine at a predetermined interval. When executing the main routine, the ECU 31 computes the feedback correction factor FAF in step 100. The air-fuel ratio is controlled based on the feedback correction factor FAF. In subsequent step 102, the ECU 31 learns the air fuel ratio. Then, in step 104, the ECU 31 learns the vapor concentration and computes the fuel injection time.

Figure 4:
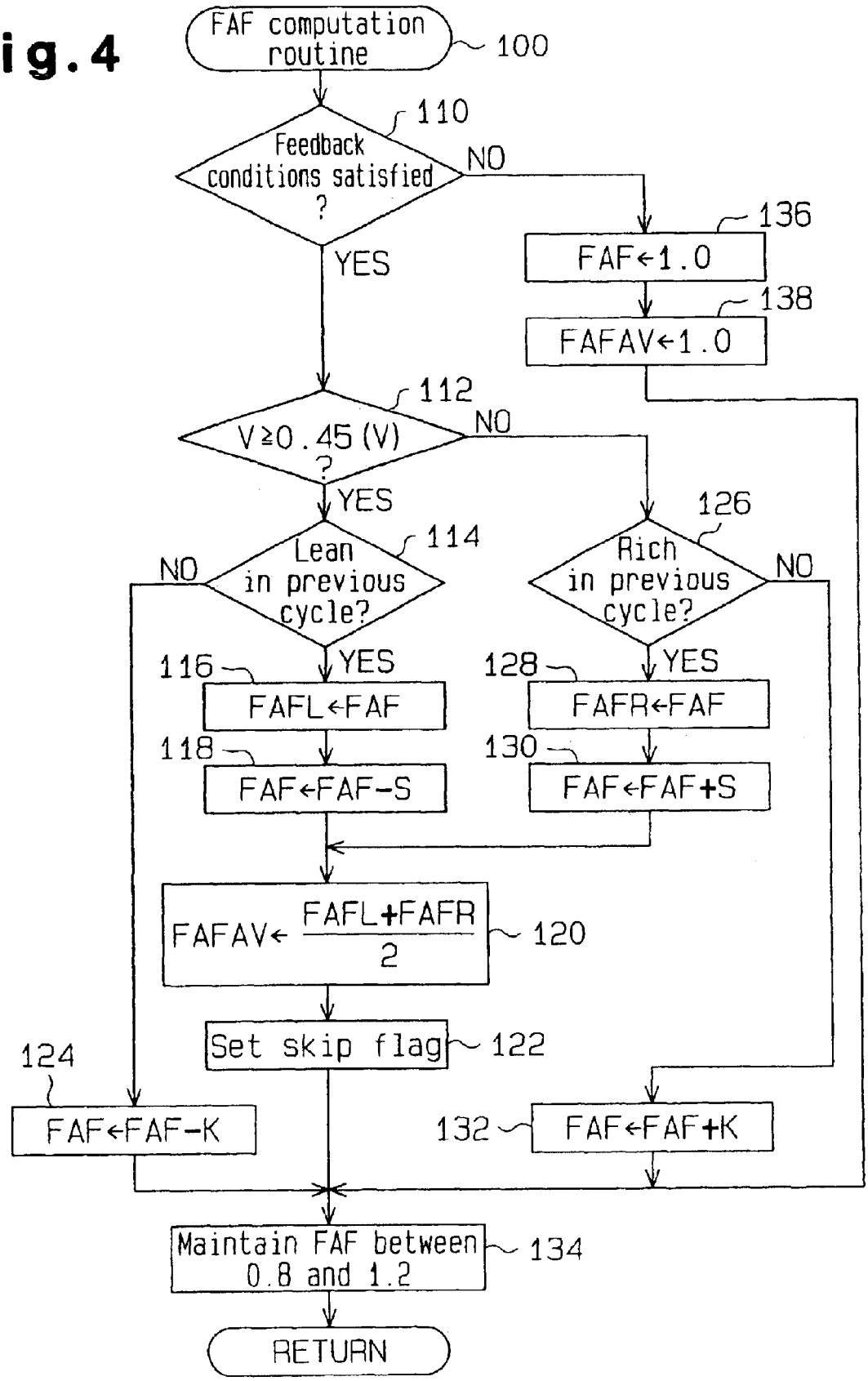
FIG. 4 is a flowchart showing a routine for computing a feedback correction factor FAF in the routine shown in FIG. 3.

Hereinafter, process of steps 100, 102, 104 will be described. First, FIG. 4 is a flowchart showing the routine for computing the feedback correction factor FAF executed in step 100 of FIG. 3. As shown in FIG. 4, the ECU 31 determines whether a feedback control condition is satisfied in step 110. If the feedback control condition is not satisfied, the ECU 31 proceeds to step 136 and fixes the feedback correction factor FAF to 1.0. Then, the ECU 31 proceeds to step 138 and fixes an average value FAFAV (the average value FAFAV will be discussed below) of the feed back correction factor FAF to 1.0. Thereafter, the ECU 31 proceeds to step 134.

If the feedback control condition is satisfied in step 110, the ECU 31 proceeds to step 112.

In step 112, the ECU 31 judges whether the output voltage V of the oxygen sensor 30 is equal to or higher than 0.45(V), or whether the air-fuel ratio of the air-fuel mixture is equal to or less than a target air-fuel ratio (for example, stoichiometric air-fuel ratio). Hereinafter, a state when the air-fuel ratio is less than the target air-fuel ratio will be described by an expression "the air-fuel mixture is rich". A state when the air-fuel ratio is higher than the target air-fuel ratio will be described by an expression "the air fuel ratio is lean". If the output voltage V is equal to or higher than 0.45(V) ($V \geqq 0.45$ (V)), that is, if the mixture is rich, the ECU 31 proceeds to step 114 and judges whether the air-fuel mixture was lean in the previous cycle. If the mixture was lean in the previous cycle, that is, if the mixture has become rich after being lean, the ECU 31 proceeds to step 116 and maintains the current feedback correction factor FAF as FAFL. After step 116, the ECU 31 proceeds to step 118. In step 118, the ECU 31 subtracts a predetermined skip value S from the current feedback correction factor FAF, and sets the subtraction result as a new feedback correction factor FAF. Therefore, the feedback correction factor FAF is quickly decreased by the skip value S.

If the ECU 31 judges that the output voltage V is less than 0.45(V) ($V<0.45$(V)) in step 112, that is, if the air-fuel mixture is lean, the ECU 31 proceeds to step 126. In step 126, the ECU 31 judges whether the air-fuel mixture was rich in the previous cycle. If the mixture was rich in the previous cycle, that is, if the mixture has become lean after being rich, the ECU 31 proceeds to step 128 and maintains the current feedback correction factor FAF as FAFR. After step 128, the ECU 31 proceeds to step 130. In step 130, the ECU 31 adds the skip value S to the current feedback correction factor FAF, and sets the addition result as a new feedback correction factor FAF. Therefore, the feedback correction factor FAF is quickly increased by the skip value S.

When proceeding to step 120 from step 118 or step 130, the ECU 31 divides the sum of the FAFL and FAFR by two and sets the division result as the average value FAFAV. That is, the average value FAFV represents the average value of the changing feedback correction factor FAF. In step S122, the ECU 31 sets a skip flag. Thereafter, the ECU 31 proceeds to step 134.

When judging that the mixture was rich in the previous cycle in step 114, the ECU 31 proceeds to step 124. In step 124, the ECU 31 subtracts an integration value K ($K<<S$) from the current feedback correction factor FAF and proceeds to step 134. Thus, the feedback correction factor FAF is gradually decreased. When judging that the mixture was lean in the previous cycle in step 126, the ECU 31 proceeds to step 132. In step 132, the ECU 31 adds the integration value K ($K<<S$) to the current feedback correction factor FAF, and then proceeds to step 134. Thus, the feedback correction factor FAF is gradually increased.

In step 134, the ECU 31 controls the feedback correction factor FAF to be within a range between an upper limit value 1.2 and a lower limit value 0.8. That is, if the feedback correction factor FAF is within the range between 1.2 and 0.8, the ECU 31 uses the feedback correction factor FAF without changing. However, if the feedback correction factor FAF is greater than 1.2, the ECU 31 sets the feedback correction factor FAF to 1.2, and if the feedback correction factor FAF is less than 0.8, the ECU 31 sets the feedback correction factor FAF to 0.8. After step 134, the ECU 31 finishes the feedback correction factor FAF computation routine.

Figure 5:
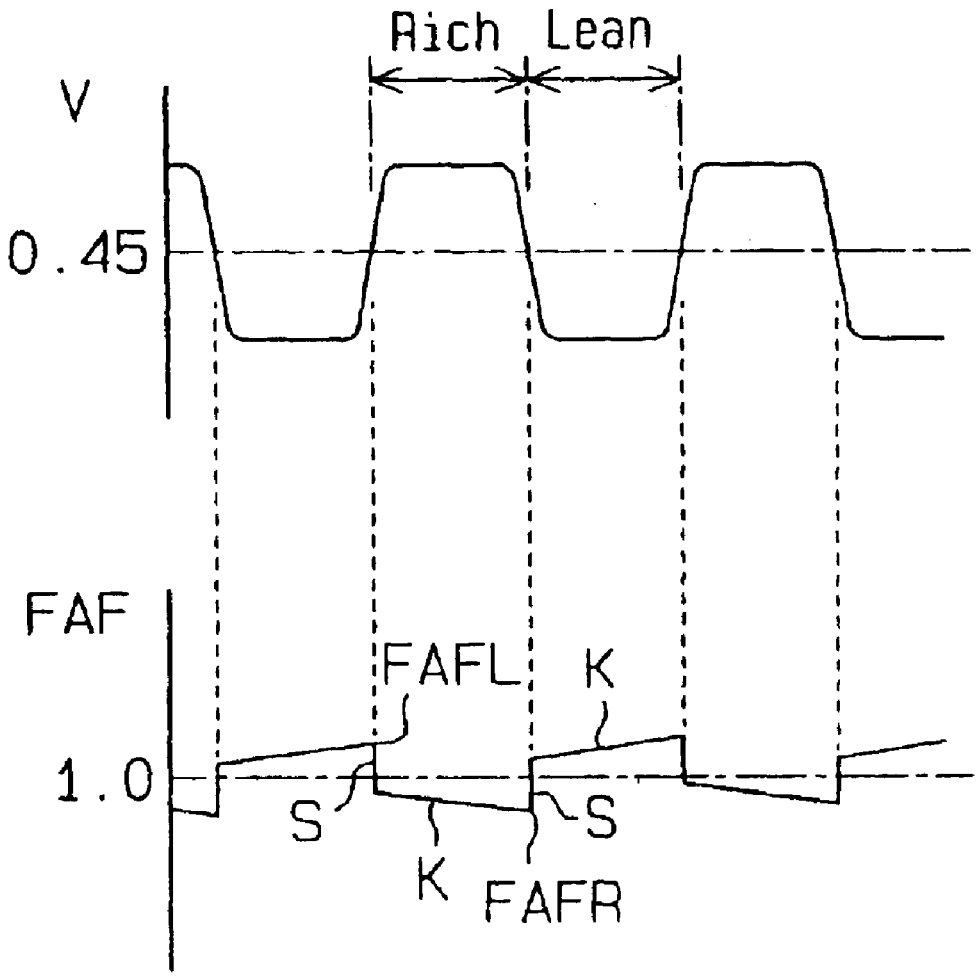
FIG. 5 is a time chart showing changes in the air-fuel ratio and changes in the air-fuel ratio feedback correction factor.

FIG. 5 is a graph showing the relationship between the output voltage V of the oxygen sensor 30 and the feedback correction factor FAF when the air-fuel ratio is maintained at the target air-fuel ratio. As shown in FIG. 5, when the output voltage V of the oxygen sensor 30 changes from a value that is less than a reference voltage, for example, 0.45(V), to a value that is greater than the reference voltage, or when the air-fuel mixture becomes rich after being lean, the feedback correction factor FAF is quickly lowered by the skip value S and then gradually decreased by the integration value K. When the output voltage V changes from a value that is greater than the reference value to a value that is less than the reference value, or when the air-fuel mixture becomes lean after being rich, the feedback correction factor FAF is quickly increased by the skip value S and then gradually increased by the integration value K.

The fuel injection amount decreases when the feedback correction factor FAF is decreased, and increases when the feedback correction factor FAF is increased. Since the feedback correction factor FAF is decreased when the air-fuel mixture becomes rich, the fuel injection amount is decreased. Since the feedback correction factor FAF is increased when the air-fuel mixture becomes lean, the fuel injection amount is increased. As a result, the air-fuel ratio is controlled to proximate the target air-fuel ratio (stoichiometric air-fuel ratio). As shown in FIG. 5, the feedback correction factor FAF fluctuates in a range about the reference value, or 1.0.

In FIG. 5, the value FAFL represents the feedback correction factor FAF when the air-fuel mixture becomes rich after being lean. The value FAFR represents the feedback correction factor FAF when the air-fuel mixture becomes lean after being rich.

Figure 6:
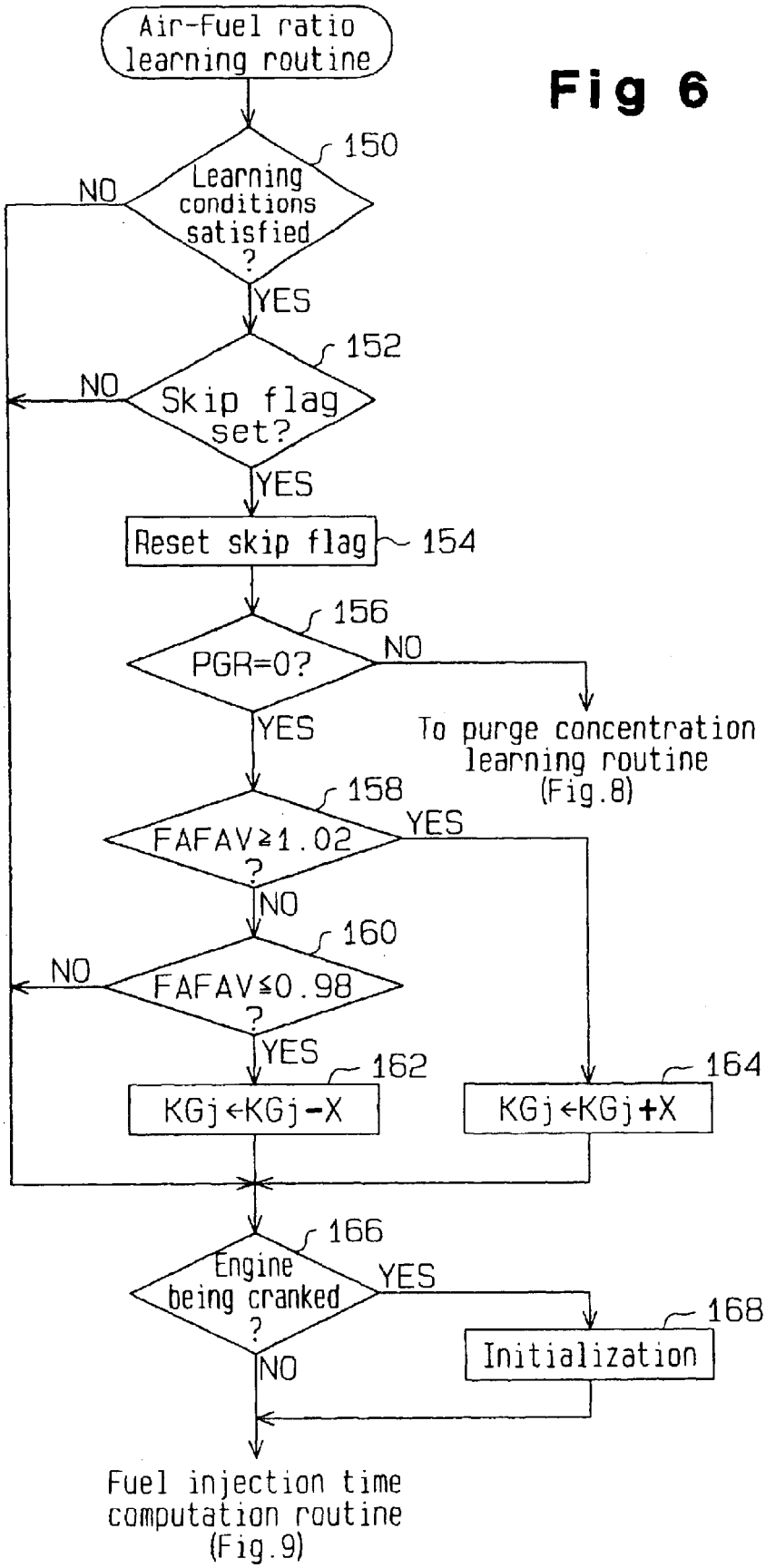
FIG. 6 is a flow chart showing a routine for learning the air-fuel ratio of the routine shown in FIG. 3.

FIG. 6 is a flowchart showing the air-fuel ratio learning routine, which is executed in step 102 of FIG. 3. In step 150 of the flowchart of FIG. 6, the ECU 31 judges whether learning condition of the air-fuel ratio is satisfied. If the condition is not satisfied, the ECU 31 jumps to step 166. If the condition is satisfied, the ECU 31 proceeds to step 152. In step 152, the ECU 31 judges whether the skip flag is set (see step 122 in FIG. 4). If the skip flag is not set, the ECU 31 jumps to step 166. If the skip flat is set, the ECU 31 proceeds to step 154 and resets the skip flag. The ECU 31 then proceeds to step 156. That is, if the skip value S is subtracted from the feedback correction factor FAF in step 118 of FIG. 5 or if the skip value S is added to the feedback correction factor FAF in step 130 of FIG. 5, the ECU 31 proceeds to step 156. Hereinafter, when the feedback correction factor FAF is abruptly changed by the skip value S, the change is described by an expression "the feedback correction factor FAF is skipped".

In step 156, the ECU 31 judges whether a purge ratio PGR is zero. In other words, the ECU 31 judges whether the fuel vapor is being purged (whether the purge control valve 22 is open). The purge ratio PGR refers to the ratio of the flow rate of purge gas to the flow rate of intake air flowing in the intake passage 10. If the purge ratio PGR is not zero, that is, if the fuel vapor is being purged, the ECU 31 proceeds to a vapor concentration learning routine shown in FIG. 8. If the purge ratio PGR is zero, or if the fuel vapor is not being purged, the ECU 31 proceeds to step 158 and learns the air-fuel ratio.

In step 158, the ECU 31 judges whether the average value FAFAV of the feedback correction factor FAF is equal to or greater than 1.02. If the average value FAFAV is equal to or greater than 1.02 (FAFV≧1.02), the ECU 31 proceeds to step 164. In step 164, the ECU 31 adds a predetermined fixed value X to a current learning value KGj of the air-fuel ratio. Several learning areas j are defined in the RAM 34 of the ECU 31. Each learning area j corresponds to one of different engine load regions and stores a learning value KGj. Each learning value KGj corresponds to a different air-fuel ratio. Therefore, in step 164, the learning value KGj in a learning area j that corresponds to the current engine load is renewed. Thereafter, the ECU 31 proceeds to step 166.

If the average value FAFAV is determined to be less than 1.02 in step 158 (FAFAF<1.02), the ECU 31 proceeds to step 160. In step 160, the ECU 31 judges whether the average value FAFAV is equal to or less than 0.98. If the average value FAFAV is equal to or less than 0.98 (FAFAV≦0.98), the ECU proceeds to step 162. In step 162, the ECU 31 subtracts the fixed value X from the learning value KGj stored in one of the learning areas j that corresponds to the current engine load. If the average value FAFAV is greater than 0.98 (FAFAV>0.98) in step 160, that is, if the average value FAFAV is between 0.98 and 1.02, the ECU 31 jumps to step 166 without renewing the learning value KGj of the air-fuel ratio.

In step 166, the ECU 31 judges whether the engine 8 is being started, or being cranked. If the engine 8 is being cranked, the ECU 31 proceeds to step 168. In step 168, the ECU 31 executes an initiation process. Specifically, the ECU 31 sets a vapor concentration value FGPG to zero and clears a purging time count value CPGR. The ECU 31 then proceeds to a fuel injection time computation routine shown in FIG. 9. If the engine 8 is not being cranked in step 166, the ECU 31 directly proceeds to the fuel injection time computation routine shown in FIG. 9.

Figure 8:
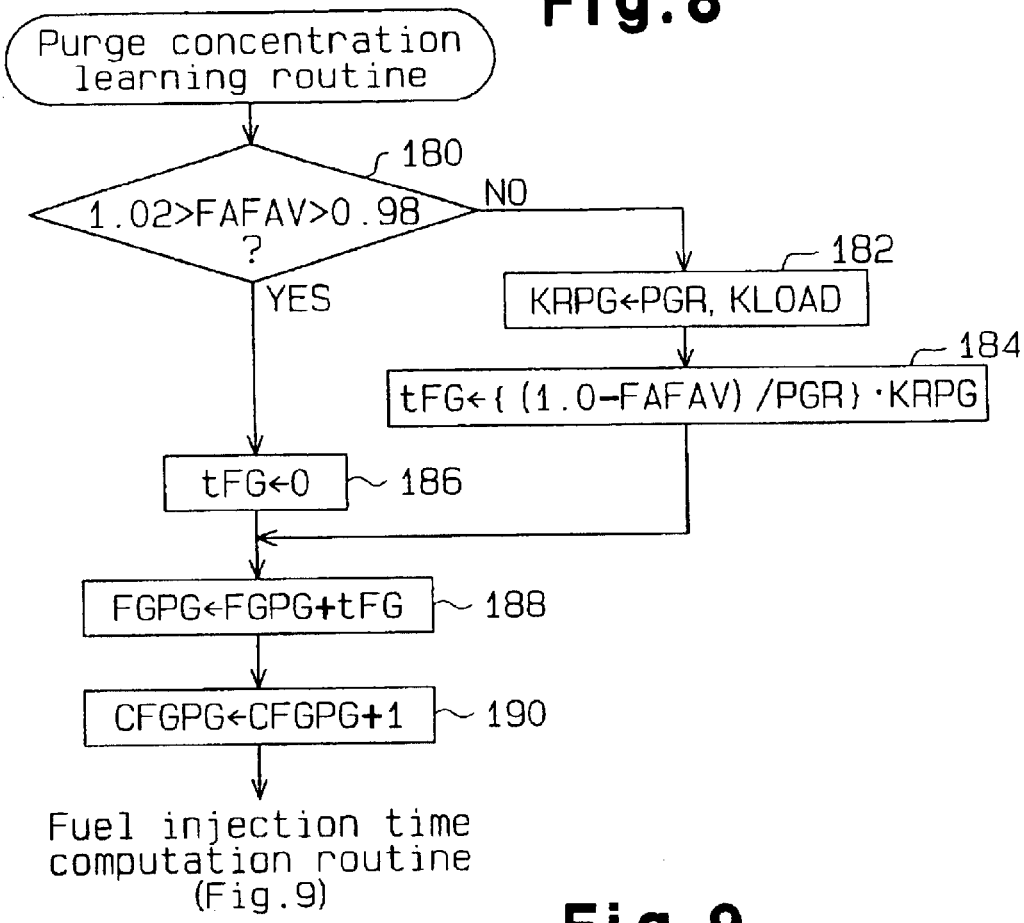
FIG. 8 is a flowchart showing the routine for learning the vapor concentration in the routine shown in FIG. 3.
Figure 9:
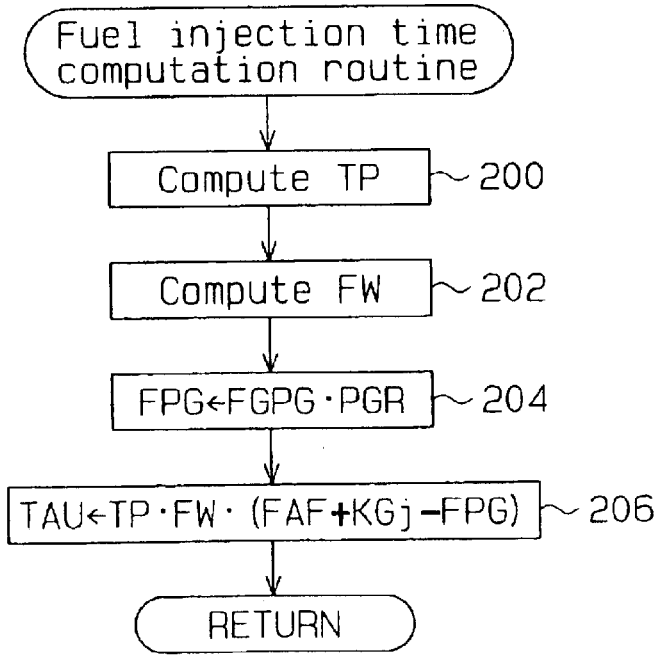
FIG. 9 is a flowchart showing a routine for computing a time of fuel injection in the routine shown in FIG. 3.

FIG. 8 is a flowchart showing the vapor concentration learning routine, which is executed in step 104 of FIG. 3. FIG. 9 is a flowchart showing the fuel injection time computation routine executed in step 104 of FIG. 3.

Figure 7:
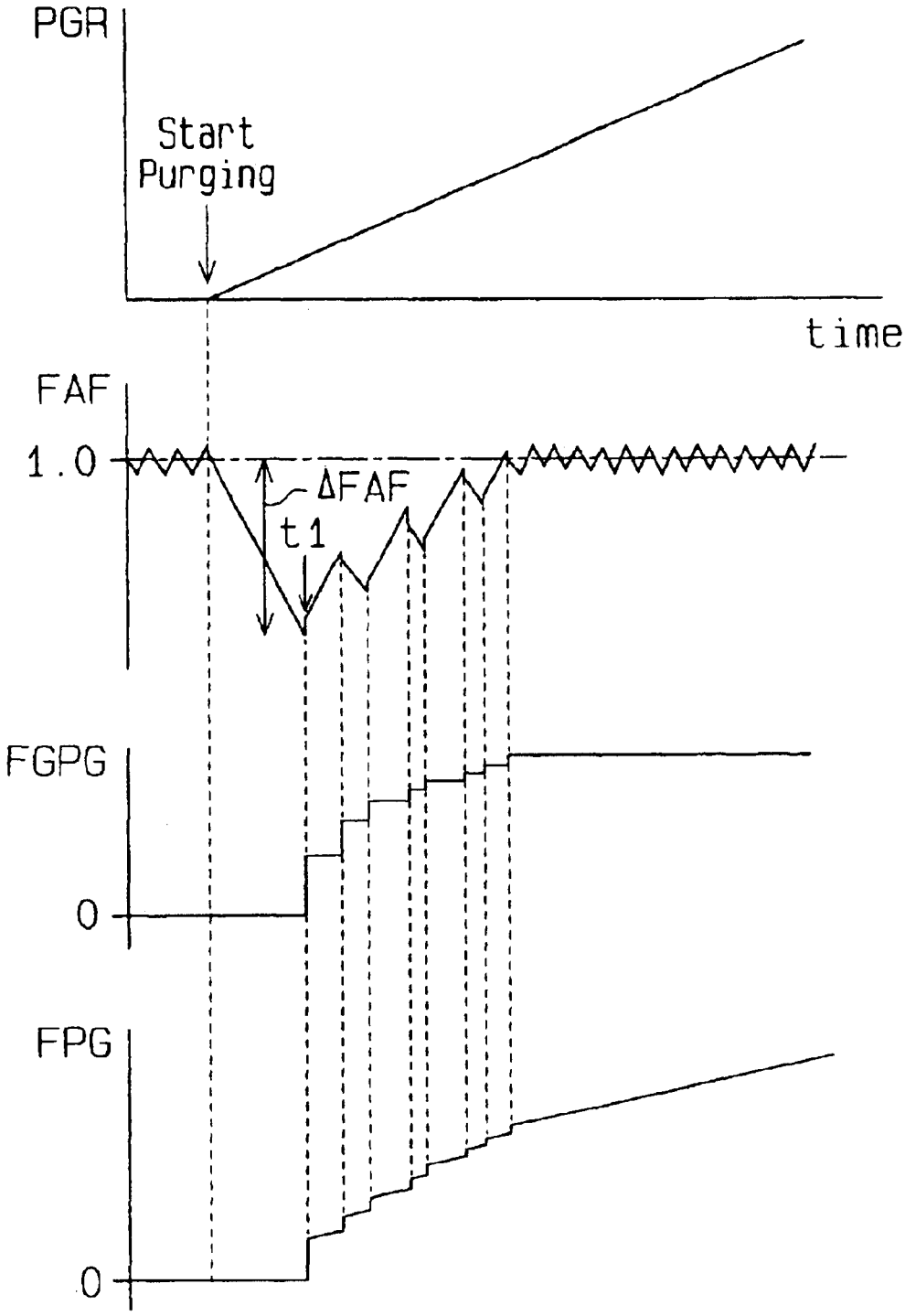
FIG. 7 is graph for explaining the theory of learning of vapor concentration.

Prior to the description of the vapor concentration learning routine of FIG. 8, the concept of the vapor concentration learning will be explained referring to the graph of FIG. 7. Learning of the vapor concentration is initiated with accurately obtaining the vapor concentration. FIG. 7 illustrates the learning process of the vapor concentration value FGPG.

A purge air-fuel ratio correction factor (hereinafter referred to as purge A/F correction factor) FPG reflects the amount of fuel vapor drawn into the combustion chamber and is computed by multiplying the vapor concentration value FGPG with the purge ratio PGR. The vapor concentration value FGPG is computed by the following equations (1), (2) every time the feedback correction factor FAF is changed by the skip value S (see steps 118 and 130 of FIG. 4).

$$tFG \leftarrow \{(1-FAFAV)/PGR\} \cdot KRPG \quad (1)$$

$$FGPG \leftarrow FGPG + tFG \quad (2)$$

Figure 14:
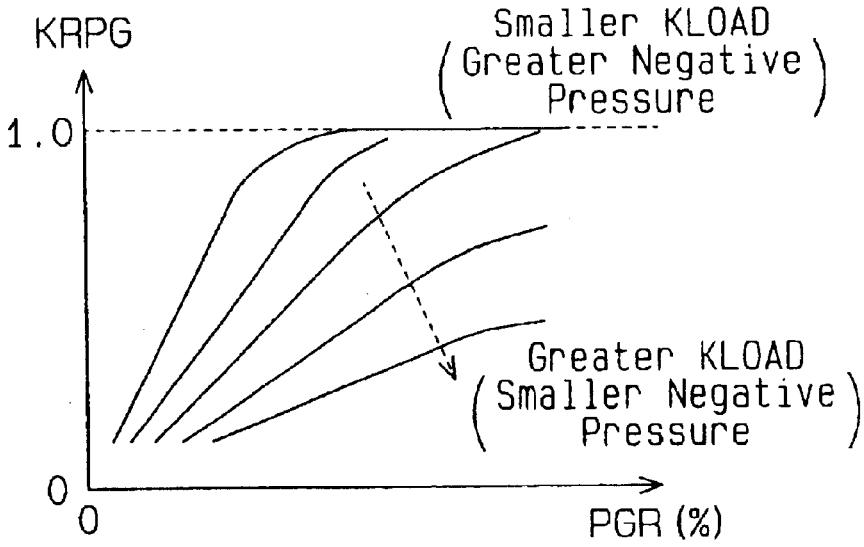
FIG. 14 is a map for computing a renew amount correction factor KRPG according to the purge ratio and the load ratio.

As described in step 120 of FIG. 4, the value FAFAV represents the average value of the feedback correction factor FAF. The value KRPG is a renew amount correction factor. As shown in FIG. 14, the renew amount correction factor KRPG is computed based on a map of FIG. 14 according to the purge ratio PGR and a load ratio KLOAD. This map of FIG. 14 is stored in the ROM 33 in advance. The load ratio KLOAD represents the ratio of the load on the engine 8 to the maximum load. In this embodiment, the load ratio KLOAD is defined as the ratio of the actual intake flow rate to the maximum intake flow rate to the engine 8. The actual intake flow rate is detected by the intake flow rate sensor 27. A great value of the load ratio KLOAD represents a state in which the intake pressure is high and the intake negative pressure is small. A small value of the load ratio KLOAD represents a state in which the intake pressure is low and the intake negative pressure is great. The renew amount correction factor KRPG is set to a smaller value as the load ratio KLOAD is increased, or as the intake negative pressure has a smaller value. The renew amount correction factor KRPG is set to a greater value, or closer to 1.0, as the load ratio KLOAD is decreased, or as the intake negative pressure has a greater value. The renew amount correction factor KRPG is set to a greater value as the purge ratio PGR is increased, and is set to a smaller value as the purge ratio PGR is decreased.

Figure 15:
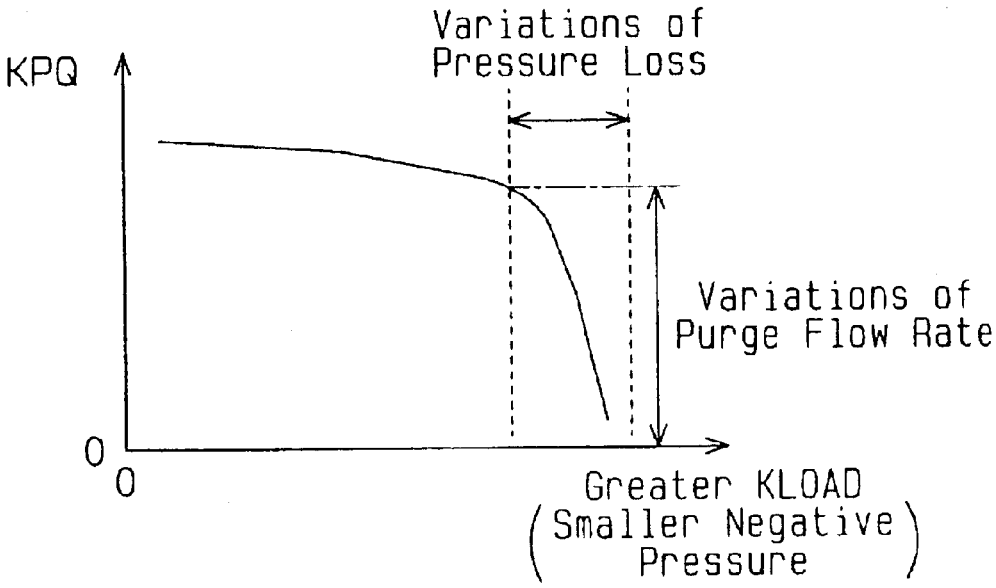
FIG. 15 is a graph showing the relationship between the load ratio of the internal combustion engine and the purge gas flow rate when the purge control valve is fully opened.

That is, the purge ratio PGR is a theoretical ratio of the purge gas flow rate to the intake flow rate through the intake passage 10. A small value of the purge ratio PGR represents a state in which the purge gas flow rate is small relative to the intake flow rate. When the purge ratio is small, the intake negative pressure acting on the intake passage 10 is also small. FIG. 15 shows the relationship between the load ratio KLOAD and the purge gas flow rate KPQ when the purge control valve 22 is fully opened. As shown in the graph, the purge gas flow rate KPQ with the purge control valve 22 fully opened is decreased as the load ratio KLOAD is increased. However, as the load ratio KLOAD is increased, or as the intake negative pressure is decreased, the pressure loss at the purge control valve 22 varies in a wider range. Also, the purge gas flow rate KPQ varies in a wider range when the purge control valve 22 is fully opened. Since the pressure loss of the purge control valve 22 in the intake negative pressure varies for each engine 8, the flow rate of gas purged through the purge control valve 22 varies for each engine 8 if the intake negative pressure and the purge ratio are both small. Therefore, if the renew amount of the vapor concentration value (vapor concentration learning value FGPG) to a small value when the purge ratio PGR is small, variations of the purge gas flow rate are not taken into consideration. This can cause an erroneous learning of the vapor concentration. Thus, in this embodiment, the renew amount correction factor KRPG is computed based on the map of FIG. 14, or on the relationship between the purge ratio PGR and the load ratio KLOAD.

The renew amount tFG of the vapor concentration value FGPG is computed based on the average value FAFAV, the purge ratio PGR, and the renew amount correction factor KRPG. The computed renew amount tFG is added to the vapor concentration value FGPG every time the feedback correction factor FAF is changed by the skip value S.

Since the air-fuel mixture becomes rich as shown in FIG. 7 when the purging is started, the feedback correction factor FAF is decreased so that the actual air-fuel ratio seeks the stoichiometric air-fuel ratio. When the air-fuel mixture is judged to have become lean after being rich based on the detection result of the oxygen sensor 30 at time t1, the feedback correction factor FAF is increased. The change amount of the feedback correction factor FAF from when the purging is started to time t1 is represented by ΔFAF. The change amount ΔFAF represents the amount of change in the air-fuel ratio due to the purging. The change amount ΔFAF also represents the vapor concentration at time t1.

After time t1, the air-fuel ratio is maintained at the stoichiometric air-fuel ratio. Thereafter, to put average value FAFAV of the feedback correction factor FAF to 1.0 while maintaining the air-fuel ratio to the stoichiometric air-fuel ratio, the vapor concentration value FGPG is gradually renewed every time the feedback correction factor FAF is changed by the skip value S. As shown by the above equation (1), the renew amount tFG for a single renewal of the vapor concentration value FGPG is represented by $\{(1-FAFAV)/PGR\}\cdot KRPG$.

After the vapor concentration value FGPG is renewed for several times as shown in FIG. 7, the average value FAVAV of the feedback correction factor FAF returns to 1.0. Thereafter, the vapor concentration value FGPG is constant. This means that the vapor concentration value FGPG accurately represents the actual vapor concentration and, in other words, that the learning of the vapor concentration is completed.

The amount of fuel vapor drawn into the combustion chamber is represented by a value that is obtained by multiplying the vapor concentration value FGPG per unit purge ratio with the purge ratio PGR. Therefore, the purge A/F correction factor FPG (FPG=FGPG·PGR), which reflects the amount of the fuel vapor, is renewed every time the vapor concentration value FGPG is renewed as shown in FIG. 7. The purge A/F correction factor FPG is therefore increased as the purge ratio PGR is increased.

Even if the learning of the vapor concentration is completed after the purging is started, the feedback correction factor FAF is displaced from 1.0 if the vapor concentration is changed. At this time, the renew amount tFG of the vapor concentration value FGPG is computed by using the equation (1).

The vapor concentration learning routine shown in FIG. 8 will now be described. The routine of FIG. 8 is started when the ECU 31 judges that the purging is being executed in step 156 of FIG. 6. In step 180, the ECU 31 judges whether the average value FAFAV of the feedback correction factor FAF is within a predetermined range. That is, the ECU 31 judges whether the inequality 1.02>FAFAV>0.98 is satisfied. If the inequality 1.02>FAFAV>0.98 is satisfied, the ECU 31 proceeds to step 186. In step 186, the ECU 31 sets the renew amount tFG to zero and proceeds to step 188. In this case, the vapor concentration value FGPG is not renewed.

If the average value FAFAV is equal to greater than 1.02 (FAFAV>1.02) or if the average value FAFAV is equal to or less than 0.98 (FAFAV≦0.98) in step 180, the ECU 31 proceeds to step 182. In step 182, the ECU 31 computes the renew amount correction factor KRPG based on the map of FIG. 14, which defines the relationship between the purge ratio PGR and the load ratio KLOAD.

Then, the ECU 31 proceeds to step 184 and computes the renew amount tFG based on the equation (1) by using the renew amount correction factor KRPG obtained in step 182. Thereafter, the ECU 31 proceeds to step 188. In step 188, the ECU 31 adds the renew amount tFG to the vapor concentration value FGPG. In step 190, the ECU 31 increments a renew counter CFGPG by one. The renew counter CFGPG represents the number of times the vapor concentration value FGPG has been renewed. The ECU 31 then proceeds to a fuel injection time computation routine shown in FIG. 9.

Next, the fuel injection time computation routine of FIG. 9 will be described.

In step 200, the ECU 31 computes a basic fuel injection time TP based on an engine load Q/N and an engine speed NE. The basic fuel injection time TP is a value obtained through experiments and previously stored in the ROM 33. The basic fuel injection time TP is designed to match the air-fuel ratio with a target air-fuel ratio, and is a function of the engine load Q/N (the intake flow rate Q/the engine speed NE) and the engine speed NE.

Then, in step 202, the ECU 31 computes a correction factor FW. The correction factor FW is used for increasing the fuel injection amount when the engine 8 is being warmed or when the vehicle is accelerated. When there is no need for a correction to increase the fuel injection amount, the correction factor FW is set to 1.0.

In step 204, the ECU 31 multiplies the vapor concentration value FGPG by the purge ratio PGR to obtain the purge A/F correction factor FPG. The purge A/F correction factor FPG is set to zero from when the engine 8 is started to when the purge is started. After the purging is started, the purge A/F correction factor FPG is increased as the fuel vapor concentration is increased. If the purging is temporarily stopped while the engine 8 is running, the purge A/F correction factor FPG is set at zero as long as the purging is not started again.

Thereafter, the ECU 31 computes the fuel injection time TAU according to the following equation (3) in step 206. The ECU 31 thus completes the fuel injection time computation routine.

$$TAU \leftarrow TP \cdot FW \cdot (FAF + KGj - FPG) \quad (3)$$

As described above, the feedback correction factor FAF is used for controlling the air-fuel ratio to match with a target air-fuel ratio based on signals from the oxygen sensor 30. The target air-fuel ratio may have any value. In this embodiment, the target air-fuel ratio is set to the stoichiometric air-fuel ratio. In the following description, a case where the target air-fuel ratio is set to the stoichiometric air-fuel ratio will be discussed. When the air-fuel ratio is too low, that is, when the air-fuel mixture is too rich, the oxygen sensor 30 outputs a voltage of approximately 0.9(V). When the air-fuel ratio is too high, that is, when the air-fuel mixture is too lean, the oxygen sensor 30 outputs a voltage of approximately 0.1(V).

Figure 10:
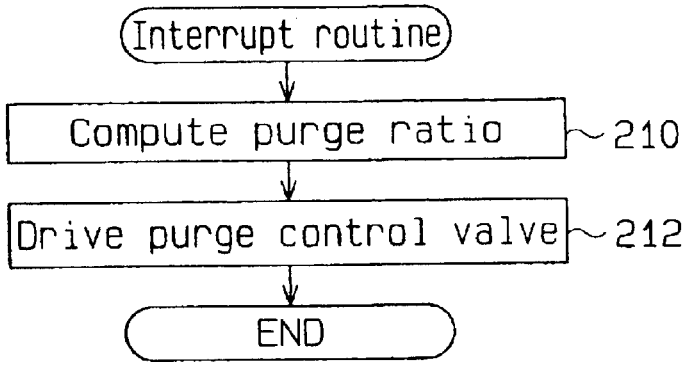
FIG. 10 is an interrupt routine executed by the ECU shown in FIG. 2.

FIG. 10 is a flowchart showing an interrupt routine that is handled during the main routine of FIG. 3. The interrupt routine of FIG. 10 is handled at a predetermined computation cycle for computing the duty ratio DPG of the driving pulse signal sent to the purge control valve 22. When handling the routine of FIG. 10, the ECU 31 first computes the purge ratio in step 210. Then, in step 212, the ECU 31 executes a procedure for driving the purge control valve 22.

Figure 11:
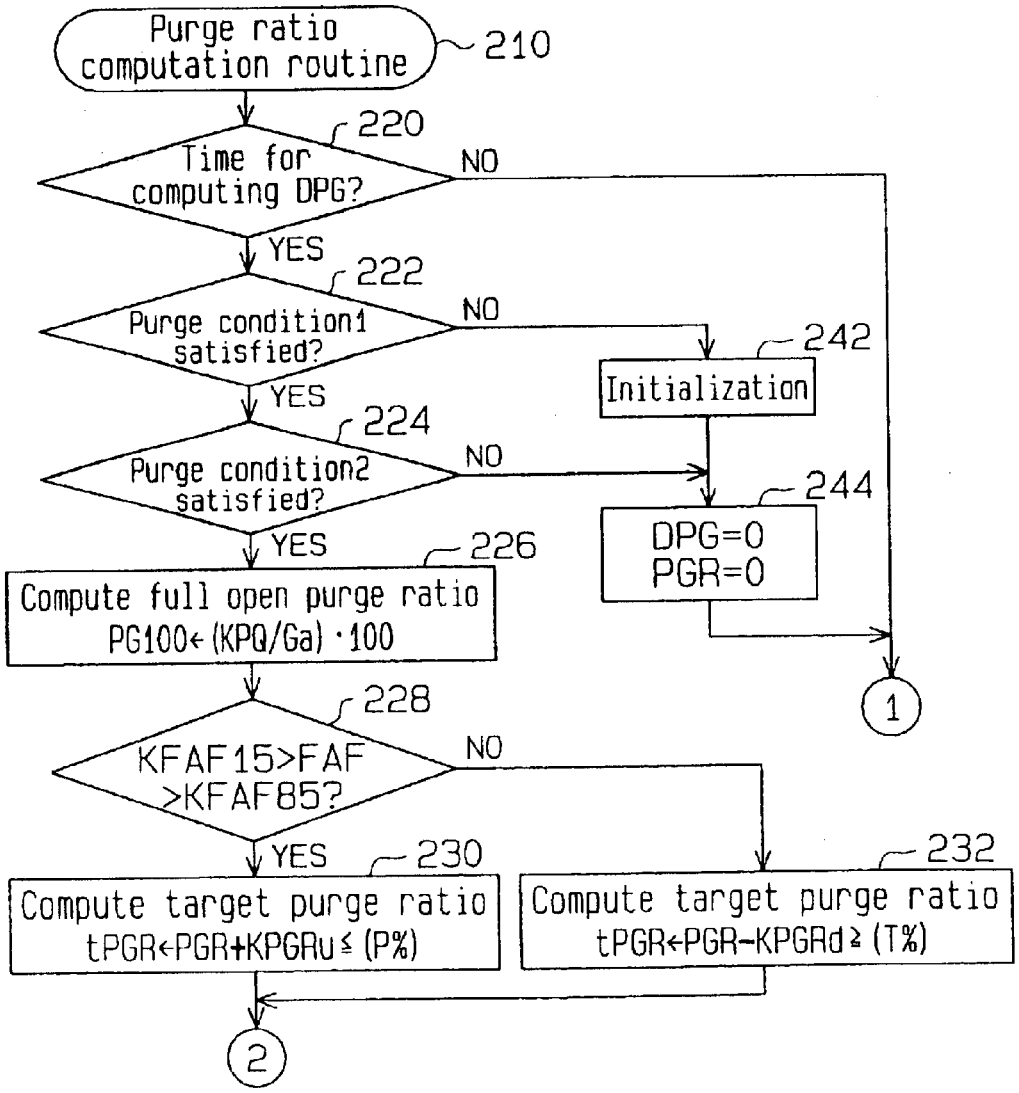
FIG. 11 is a flowchart showing a first part of a routine for computing a purge ratio shown in FIG. 10.
Figure 12:
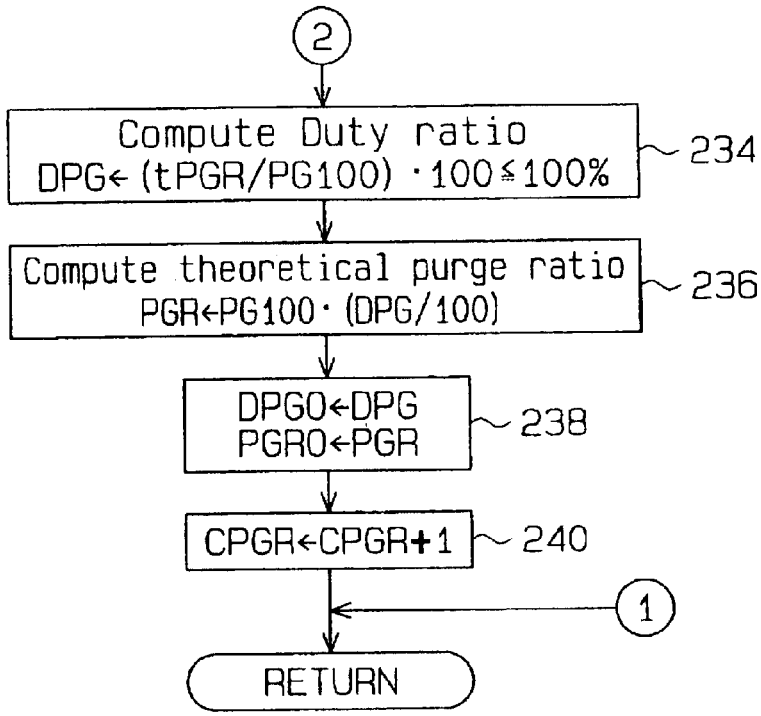
FIG. 12 is a flowchart showing a first part of a routine for computing a purge ratio shown in FIG. 10.

Procedures executed in steps 210 and 212 of FIG. 10 will be described below. FIGS. 11 and 12 are flowcharts showing a routine for computing the purge ratio, which is executed in step 210 of FIG. 10.

First, in step 220 of FIG. 11, the ECU 31 judges whether now is the time to compute the duty ratio DPG. If now is not the time, the ECU 31 suspends the purge ratio computation routine. If now is the time to compute the duty ratio DPG, the ECU 31 proceeds to step 222. In step 222, the ECU 31 judges whether a purge condition 1 is satisfied. For example, the ECU 31 judges whether the warming of the engine 8 is completed. If the purge condition 1 is not satisfied, the ECU 31 proceeds to step 242 and executes an initializing process. The ECU 31 then proceeds to step 244. In step 244, the ECU 31 sets the duty ratio DPG and the purge ratio PGR to zero and suspends the purge ratio computation routine. If the purge condition 1 is satisfied in step 222, the ECU 31 proceeds to step 224 and judges whether a condition 2 is satisfied. For example, the ECU 31 judges that the purge condition 2 is satisfied when the air-fuel ratio is being feedback controlled and fuel is being supplied. If the purge condition 2 is not satisfied, the ECU 31 proceeds to step 244. If the purge condition 2 is satisfied, the ECU 31 proceeds to step 226.

In step 226, the ECU 31 computes a full open purge ratio PG100, which is the ratio of a full open purge gas flow rate KPQ to an intake flow rate Ga. The full open purge gas flow rate KPQ represents the purge gas flow rate when the purge control valve 22 is fully opened, and the intake flow rate Ga is detected by the intake flow rate sensor 27 (see FIG. 1). The full open purge ratio PG100 is, for example, a function of the engine load Q/N (the intake flow rate Ga/the engine speed NE) and the engine speed NE, and is previously stored in the ROM 33 in a form of a map.

As the engine load Q/N decreases, the full open purge gas flow rate KPQ increases relative to the intake flow rate Ga. The full open purge ratio PG100 is also increased as the engine load Q/N decreases. As the engine speed NE decreases, the full open purge gas flow rate KPQ increases relative to the intake flow rate Ga. Thus, the full open purge ratio PG100 increases as the engine speed NE decreases.

In step 228, the ECU 31 judges whether the feedback correction factor FAF is in the range between an upper limit value KFAF15 (KFAF15=1.15) and a lower limit value KFAF85 (KFAF85=0.85). If an inequality KFAF15>FAF>KFAF85 is satisfied, that is, if the air-fuel ratio is being feedback controlled to the stoichiometric air-fuel ratio, the ECU 31 proceeds to step 230. In step 230, the ECU 31 adds a fixed value KPGRu to the purge ratio PGR to obtain a target purge ratio tPGR (tPGR←PGR+KPGRu). That is, if the inequality KFAF15>FAF>KFAF85 is satisfied, the target purge ratio tPGR is gradually increased. An upper limit value P (for example, 6%) is set for the target purge ratio tPGR. Therefore, the target purge ratio tPGR is increased up to the upper limit value P. The ECU 31 then proceeds to step 234 of FIG. 12.

If the inequality FAF≧KFAF15 or the inequality FAF≦KFAF85 is satisfied in step 228 of FIG. 11, the ECU 31 proceeds to step 232. In step 232, the ECU 31 subtracts a fixed value KPGRd from the purge ratio PGR to obtain the target purge ratio tPGR (tPGR←PGR−KPGRd). That is, when the air-fuel ratio cannot be maintained at the stoichiometric air-fuel ratio because of the influence of purging of fuel vapor, the target purge ratio tPGR is decreased. A lower limit value T (T=0%) is set for the target purge ratio tPGR. The ECU 31 then proceeds to step 234 of FIG. 12.

In step 234 of FIG. 12, the ECU 31 divides the target purge ratio tPGR by the full open purge ratio PG100 to obtain the duty ratio DPG of the driving pulse signal sent to the purge control valve 22 (DPG←(tPGR/PG100)·100). Thus, the duty ratio DPG, or the opening degree of the purge control valve 22, is controlled in accordance with the ratio of the target purge ratio tPGR to the full open purge ratio PG100. As a result, the actual purge ratio is maintained at the target purge ratio under any running condition of the engine 8 regardless of the value of the target purge ratio tPGR.

For example, if the target purge ratio tPGR is 2% and the full open purge ratio PG100 is 10% under the current running state, the duty ratio DPG of the driving pulse is 20%, and the actual purge ratio is 2%. If the running state is changed and the full open purge ratio PG100 is changed to 5%, the driving pulse duty ratio DPG becomes 40%. At this time, the actual purge ratio becomes 2%. That is, if the target purge ratio tPGR is 2%, the actual purge ratio is maintained to 2% regardless of the running state of the engine 8. If the target purge ratio tPGR is changed to 4%, the actual purge ratio is maintained at 4% regardless of the running state of the engine 8.

In step 236, the ECU 31 multiplies the full open purge ratio PG100 by the duty ratio DPG to obtain a theoretical purge ratio PGR (PGR←PGR100·(DPG/100)). Since the duty ratio DPG is represented by (tPGR/PG100)·100, the computed duty ratio DPG becomes greater than 100% if the target purge ratio tPGR is greater than the full open purge ratio PG100.

However, the duty ratio DPG cannot be over 100%, and if the computed duty ratio DPG is greater than 100%, the duty ratio DPG is set to 100%. Therefore, the theoretical purge ratio PGR can be less than the target purge ratio tPGR.

The theoretical purge ratio PGR is used in computation of the renew amount correction factor KRPG in step 182 of FIG. 8, computation of the renew amount tFG in step 184 of FIG. 8, computation of the purge A/F correction factor FPG in step 204 of FIG. 9, and computation of the target purge ratio tPGR in steps 230, 232 of FIG. 11.

In step 238, the ECU 31 sets the duty ratio DPG to DPGO, and sets the purge ratio PGR to PGRO. Thereafter, in step 240, the ECU 31 increments a purging time count value CPGR by one. The count value CPGR represents the time elapsed since the purging is started. The ECU 31 then terminates the purge ratio computation routine.

Figure 13:
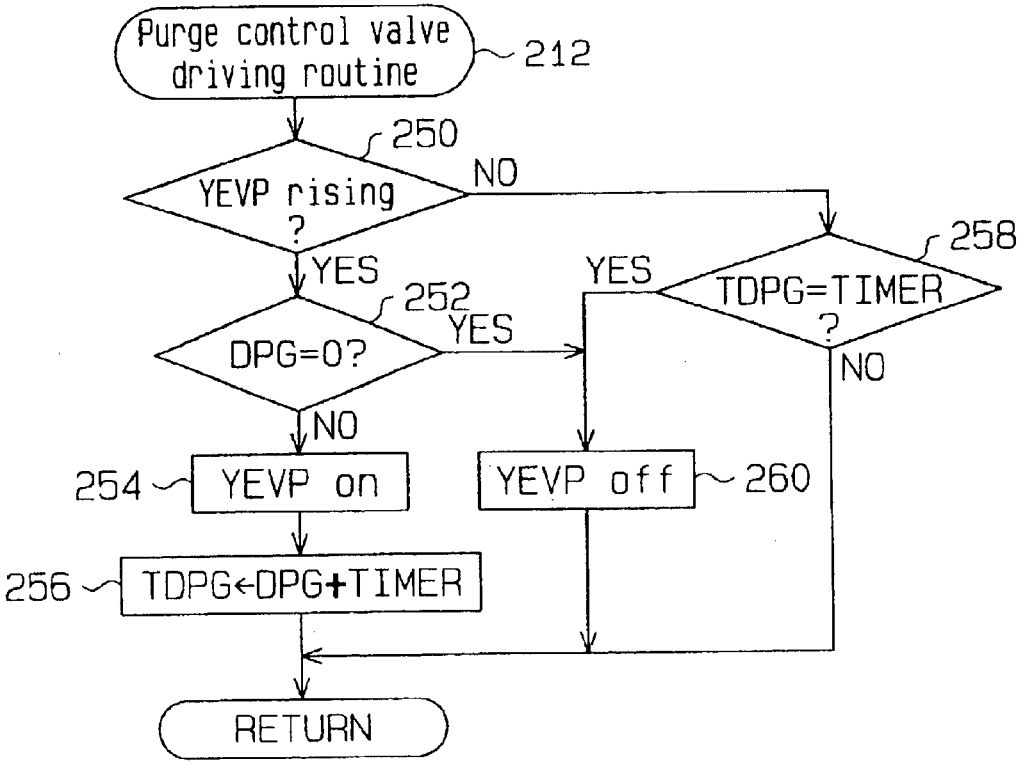
FIG. 13 is a flowchart showing a routine for actuating the purge control valve shown in FIG. 10.

FIG. 13 shows a flowchart of the procedure for driving the purge control valve 22 executed in step 212 of FIG. 10.

First in step 250 of FIG. 13, the ECU 31 judges whether a driving pulse signal YEVP sent to the purge control valve 22 is currently rising. If the driving pulse signal YEVP is rising, the ECU 31 proceeds to step 252, and judges whether the duty ratio DPG is zero. If the DPG is zero (DPG=0), the ECU 31 proceeds to step 260 and turns the driving pulse signal YEVP off. If the DPG is not zero, the ECU 31 proceeds to step 254 turns the driving pulse signal YEVP on. In step 256, the ECU 31 adds the duty ratio DPG to the present time TIMER to obtain an off time TDPG of the driving pulse signal YEVP (TDPG←DPG+TIMER). The ECU 31 then terminates the purge control valve driving routine.

If the ECU 31 judges that the driving pulse signal YEVP is not rising in step in step 250, the ECU 31 proceeds to step 258. In step 258, the ECU 31 judges whether the present time TIMER is the off time TDPG of the driving pulse signal YEVP. If the present time TIMER is the off time TDPG, the ECU 31 proceeds to step 260 and turns off the driving pulse signal YEVP and terminates the purge control valve driving routine. If the present time TIMER is not the off time TDPG, the ECU 31 terminates the purge control valve driving routine.

The above described embodiment has the following advantages.

In this embodiment, if the air-fuel ratio is deviated from a target air-fuel ratio while the fuel vapor is being purged, the vapor concentration learning value FGPG is renewed. At this time, if the load ratio KLOAD of the engine 8 is great, the renew amount tFG of the vapor concentration learning value FGPG is set to have a smaller value compared to a case where the load ratio KLOAD is small. Therefore, the variations of the purge gas flow rate when the load ratio KLOAD of the engine 8 is great, that is, the variations of the purge gas flow rate when the intake negative pressure is small, are taken into consideration when the learning of the vapor concentration is performed. This improves the accuracy of the air-fuel ratio control of the engine 8.

In this embodiment, when the purge ratio PGR of the purge flow gas rate through the purge control valve 22 is small, the renew amount tFG of the vapor concentration leaning value FGPG is set to a smaller value compared to a case where the purge ratio PGR is great. When the purge gas flow rate is low and the purge ratio PGR is small, the intake negative pressure acting on the intake passage 10 is small and the pressure loss at the purge control valve 22 varies in a wide range. Accordingly, the purge flow gas rate varies in a wide range. According to this embodiment, the variations of the purge gas flow rate when the purge ratio is small and the intake negative pressure is low are taken into consideration when the learning of the vapor concentration is performed. This improves the accuracy of the air-fuel ratio control of the engine 8.

It should be apparent to those skilled in the art that the present invention may be embodied in many other specific forms without departing from the spirit or scope of the invention. Particularly, it should be understood that the invention may be embodied in the following forms.

In the above described embodiment, the intake flow rate, which is detected by the intake flow rate sensor 27, may be used as the load of the engine 8 instead of the load ratio KLOAD, and the renew amount correction factor KRPG may be computed based on the intake flow rate and the purge ratio PGR. This is because the intake negative pressure generated in the intake passage 10 is small when the intake flow rate drawn into the engine 8 is great, and the intake negative pressure generated in the intake passage 10 is great when the intake flow rate is small.

In the above described embodiment, the intake pressure may be used as the load of the engine 8 instead of the load ratio KLOAD, and the renew amount correction factor KRPG may be computed based on the intake pressure and the purge ratio PGR. This is because the intake negative pressure generated in the intake passage 10 is small when the intake pressure of the engine 8 is great, and the intake negative pressure generated in the intake passage 10 is great when the intake pressure is small. In this case, an intake pressure sensor for detecting the intake pressure is provided in the intake passage 10, and the detected pressure of the intake pressure sensor is used as the intake pressure.

In the above described embodiment, the renew amount correction factor KRPG is computed based on the map defining the relationship between the purge ratio PGR and the load ratio KLOAD. However, the renew amount correction factor KRPG may be computed based only on the load ratio KLOAD.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling the air-fuel ratio of air-fuel mixture drawn into a combustion chamber of an engine, wherein an intake passage of the engine is connected to a canister, wherein the canister adsorbs fuel vapor generated in a fuel tank, wherein gas containing fuel vapor is purged as purge gas from the canister to the intake passage through a purge control device by intake negative pressure generated in the intake passage, the apparatus comprising:

a sensor for detecting the air-fuel ratio of the air-fuel mixture; and a computer, wherein, according to a deviation of a detected air-fuel ratio relative to a target air-fuel ratio, the computer renews a vapor concentration value representing the concentration of fuel vapor contained in the purge gas by a predetermined renew amount at a time, wherein the computer sets the amount of fuel supplied to the combustion chamber according to the renewed vapor concentration value such that the detected air-fuel ratio seeks the target air-fuel ratio, and wherein the computer sets a smaller value of the renew amount for a greater value of the load on the engine.

2. The apparatus according to claim 1, wherein the engine load is correlated with the intake negative pressure, and wherein the intake negative pressure has a smaller value for a greater value of the engine load.

3. The apparatus according to claim 1, wherein the computer uses the flow rate of air flowing through the intake passage as a parameter indicating the engine load, thereby determining the renew amount.

4. The apparatus according to claim 1, wherein the computer uses the pressure of air flowing through the intake passage as a parameter indicating the engine load, thereby determining the renew amount.

5. The apparatus according to claim 1, further comprising an air flow rate sensor for detecting the flow rate of air flowing through the intake passage, wherein the computer computes the ratio of an air flow rate detected by the flow rate sensor to a predetermined maximum air flow rate, and sets the computed ratio as an engine load ratio, and wherein the computer uses the engine load ratio as a parameter indicating the engine load, thereby determining the renew amount.

6. The apparatus according to claim 1, wherein the computer sets a smaller value of the renew amount for a smaller value of a purge ratio, the purge ratio representing the ratio of the flow rate of the purge gas purged to the intake passage to the flow rate of air flowing through the intake passage.

7. A vehicle, comprising:

an engine having a combustion chamber, in which air-fuel mixture is drawn;

an intake passage connected to the combustion chamber;

a fuel tank for storing fuel;

a canister that adsorbs fuel vapor generated in the fuel tank;

a purge line connecting the canister to the intake passage;

a purge control valve located in the purge line, wherein, when the purge control valve is opened, gas containing fuel vapor is purged as purge gas from the canister to the intake passage through the purge line by intake negative pressure generated in the intake passage;

an air-fuel ratio sensor for detecting the air-fuel ratio of the air-fuel mixture;

an air flow rate sensor for detecting the flow rate of air flowing through the intake passage; and an electronic control unit, wherein, according to a deviation of a detected air-fuel ratio relative to a target air-fuel ratio, the electronic control unit renews a vapor concentration value representing the concentration of fuel vapor contained in the purge gas by a predetermined renew amount at a time, wherein the electronic control unit sets the amount of fuel supplied to the combustion chamber according to the renewed vapor concentration value such that the detected air-fuel ratio seeks the target air-fuel ratio, wherein the electronic control unit computes the ratio of an air flow rate detected by the air flow rate sensor to a predetermined maximum air flow rate, and sets the computed ratio as an engine load ratio, and wherein the electronic control unit sets a smaller value of the renew amount for a greater value of the engine load ratio.

8. The vehicle according to claim 7, wherein the electronic control unit sets a smaller value of the renew amount for a smaller value of a purge ratio, the purge ratio representing the ratio of the flow rate of the purge gas purged to the intake passage to the flow rate of air flowing through the intake passage.

9. A method for controlling the air-fuel ratio of air-fuel mixture drawn into a combustion chamber of an engine, wherein an intake passage of the engine is connected to a canister, wherein the canister adsorbs fuel vapor generated in a fuel tank, wherein gas containing fuel vapor is purged as purge gas from the canister to the intake passage through a purge control device by intake negative pressure generated in the intake passage, the method comprising:

detecting the air-fuel ratio of the air-fuel mixture;

renewing a vapor concentration value representing the concentration of fuel vapor contained in the purge gas by a predetermined renew amount at a time according to a deviation of a detected air-fuel ratio relative to a target air-fuel ratio;

setting the amount of fuel supplied to the combustion chamber according to the renewed vapor concentration value such that the detected air-fuel ratio seeks the target air-fuel ratio; and setting a smaller value of the renew amount for a greater value of the load on the engine.

10. The method according to claim 9, further comprising determining the renew amount by using the flow rate of air flowing through the intake passage as a parameter indicating the engine load.

11. The method according to claim 9, further comprising determining the renew amount by using the pressure of air flowing through the intake passage as a parameter indicating the engine load.

12. The method according to claim 9, further comprising:

computing the ratio of the flow rate of air flowing through the intake passage to a predetermined maximum air flow rate, and setting the computed ratio as an engine load ratio; and determining the renew amount by using the engine load ratio as a parameter indicating the engine load.

13. The method according to claim 9, further comprising setting a smaller value of the renew amount for a smaller value of a purge ratio, the purge ratio representing the ratio of the flow rate of the purge gas purged to the intake passage to the flow of air flowing through the intake passage.

* * * * *